US007308874B2

(12) United States Patent
Fujita et al.

(10) Patent No.: US 7,308,874 B2
(45) Date of Patent: Dec. 18, 2007

(54) VALVE MECHANISM FOR AN INTERNAL COMBUSTION ENGINE

(75) Inventors: Hideo Fujita, Shizuoka-ken (JP); Koichi Hatamura, Hiroshima (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 0 days.

(21) Appl. No.: 11/363,457

(22) Filed: Feb. 27, 2006

(65) Prior Publication Data

US 2006/0243233 A1 Nov. 2, 2006

Related U.S. Application Data

(63) Continuation of application No. PCT/JP04/12192, filed on Aug. 25, 2004.

(30) Foreign Application Priority Data

Aug. 25, 2003 (JP) ..... 2003-208537
Jan. 20, 2004 (JP) ..... 2004-011380

(51) Int. Cl.
*F01L 1/34* (2006.01)

(52) U.S. Cl. ..... 123/90.16; 123/90.44; 74/569

(58) Field of Classification Search ..... 123/90.16, 123/90.2, 90.39, 90.41, 90.44; 74/559, 569, 74/567

See application file for complete search history.

(56) References Cited

U.S. PATENT DOCUMENTS 4,572,118 A 2/1986 Baguéna et al.
4,714,057 A 12/1987 Wichart
5,018,487 A 5/1991 Shinkai
5,189,998 A 3/1993 Hara (Continued)

FOREIGN PATENT DOCUMENTS

DE 19708484 A1 * 9/1998

(Continued)

OTHER PUBLICATIONS

International Search Report for Application No. PCT/JP2004/012192.

(Continued)

*Primary Examiner*—Ching Chang
(74) *Attorney, Agent, or Firm*—Knobbe, Martens, Olson & Bear, LLP.

(57) ABSTRACT

A valve drive mechanism for actuating a valve of an internal combustion engine includes a cam member with a cam surface having a first portion and a second portion. A roller is configured to rotate and contact the first portion of the cam surface when the valve is in a closed position and the second portion of the cam surface with the valve is in an open position. The cam member and the roller are configured to reciprocally move relative to each other to open and close the valve. When the roller contacts the first portion, a gap within the valve drive mechanism exists between components of the valve drive mechanism on a downstream side of a force transmission path to the valve with respect to a contact point between the roller and the cam surface. A spring member urges the roller and the cam surface into contact with each other during motion between the cam member and the roller.

7 Claims, 11 Drawing Sheets

U.S. PATENT DOCUMENTS

| | | | |
|---|---|---|---|
| 5,373,818 | A | 12/1994 | Unger |
| 6,135,075 | A | 10/2000 | Boertje et al. |
| 6,386,162 | B2 | 5/2002 | Himsel |
| 6,422,187 | B2 | 7/2002 | Fischer et al. |
| 6,425,357 | B2 | 7/2002 | Shimizu et al. |
| 6,659,053 | B1 | 12/2003 | Cecur |
| 7,096,835 | B2 | 8/2006 | Fujita et al. |
| 2001/0052329 | A1 | 12/2001 | Himsel |
| 2005/0126526 | A1 | 6/2005 | Fujita et al. |
| 2006/0075982 | A1 | 4/2006 | Fujita et al. |
| 2006/0102120 | A1 | 5/2006 | Fujita et al. |
| 2006/0107915 | A1 | 5/2006 | Fujita et al. |
| 2006/0207532 | A1 | 9/2006 | Fujita et al. |
| 2006/0207533 | A1 | 9/2006 | Fujita et al. |
| 2006/0243233 | A1 | 11/2006 | Fujita et al. |

FOREIGN PATENT DOCUMENTS

| | | | | |
|---|---|---|---|---|
| DE | 10123186 | A1 | * | 11/2002 |
| JP | 62-255538 | | | 11/1987 |
| JP | 99707-1986 | | | 1/1988 |
| JP | 63-309707 | | | 12/1988 |
| JP | 02-241916 | | | 9/1990 |
| JP | 06-017626 | | | 1/1994 |
| JP | 06-093816 | | | 4/1994 |
| JP | 06-93816 | | | 4/1994 |
| JP | 06-307219 | | | 11/1994 |
| JP | 07-063023 | | | 3/1995 |
| JP | 07-133709 | | | 5/1995 |
| JP | 07-293216 | | | 11/1995 |
| JP | 09-268907 | | | 10/1997 |
| JP | 11-36833 | | | 2/1999 |
| JP | 11-036833 | | | 2/1999 |
| JP | 2000213320 | A | * | 8/2000 |
| JP | 2001-263015 | | | 9/2001 |
| JP | 2002371816 | A | * | 12/2002 |
| JP | 2003-106123 | | | 4/2003 |
| JP | 2003-239713 | | | 8/2003 |
| WO | WO 2004/097186 | A1 | | 11/2004 |
| WO | WO 2005/019607 | A1 | | 3/2005 |
| WO | WO 2005/019609 | A1 | | 3/2005 |

OTHER PUBLICATIONS

PCT International Search Report regarding PCT/JP2004/006426 mailed Aug. 3, 2004.

PCT International Search Report regarding PCTJP2004/006428 mailed Aug. 17, 2004.

Anontaphan, Thitiphol. A study of a mechanical continuous variable rocker arm (VRA), SAE technical paper series 2003-01-0022, 2003 SAE World Congress Detroit, Michigan, Mar. 3-6, 2003.

Office Action for Application No. 11/363,460 filed Feb. 27, 2006.

* cited by examiner

VALVE MECHANISM FOR AN INTERNAL COMBUSTION ENGINE

PRIORITY INFORMATION

This application is a continuation of PCT Application No. 2004JP12192, filed on Aug. 25, 2004, which claims priority under 35 U.S.C. §119 to Japanese Patent Application No. 2003-208537, filed on Aug. 25, 2003, the entire contents of these applications are expressly incorporated by reference herein.

BACKGROUND OF THE INVENTION

1. Field of the Invention

The present invention relates to a valve drive mechanism and, more particularly, to a valve drive mechanism for an internal combustion engine.

2. Description of the Related Art

Internal combustion engines often include a valve mechanism for opening and closing an intake valve or exhaust valve. Such a valve mechanism can include a rotating camshaft that is positioned between the respective valves. The camshaft can be rotated by a crankshaft of the internal combustion engine. The camshaft can include one or more cams that rotate with the camshaft. A swing member operates in synchronization with the rotating cam and rocks or swings within a predetermined range. A rocker arm can operate in synchronization with the swing member to open and close the intake valve or the exhaust valve. In certain of these valve mechanisms, in order to reduce the frictional resistance between the swing member and the rocker arm, the rocker arm is provided with a roller. A contact surface is provided on the swing member. The contact surface meets the roller comes into contact on the rocking arm. In this manner, the swing member opens and closes the valves through the rocker arm.

In certain valve mechanisms, when the rocker arm and the respective valves are held in constant contact with each other, the valves can undergo thermal expansion due to a rise in the temperature of the internal combustion engine. This expansion can cause the valve to jump or move upwardly so that each valve presses against the rocker arm towards the swing member. These can cause valve closure action to become unreliable, which can result in gas leakage causing a decrease in engine output. To prevent this upward jumping or movement of the valve, a predetermined valve clearance can be provided between the rocker arm and each valve.

When valve clearance is provided as described above, as the swing member reciprocates and the rocking or swing direction of the swing member is reversed, if there is clearance between the roller and the contact surface as described above, the rotation of the roller on the rocker is retained due to inertia. Thus, at a base circle portion of the swing member, the rocking direction of the swing member and the rotation direction in which the roller rotates becomes opposite to each other. Accordingly, when the roller meets the contact surface of the swing member, wear occurs causing a decrease in durability. In addition, the rocking motion of the swing member may not be accurately transmitted to the rocker arm, which makes it difficult to actuate each valve with reliability.

In particular, when the rotation of the roller is completely retained due to inertia, the relative speed at the time when the roller is separated from the swing member and that at the time when the roller comes into contact with the swing member are substantially same in magnitude but opposite in direction. Thus, the contact surfaces of the two members when in contact exhibit speeds of the same magnitude acting in different directions. According to the elastic hydrodynamic lubrication theory, such a condition is not conductive to the formation of a lubricant film. Thus, it is believed that this condition can easily result in lubricant film breakage causing increased adhesive wear.

In view of the situation described above, a valve mechanism has been designed to prevent adhesive wear between the roller and the contact surface. See, e.g., Japanese Patent Application JP-A-2001-63015. In such a system, the rocker arm is rockably supported by a hydraulic lash adjustor. In this manner, the support position of the rocker arm can be appropriately corrected by the hydraulic lash adjustor to correct the relation between the roller of the rocker arm and the contact surface of the swing member. Accordingly, when the swing member makes reciprocating motion, the swing member and the roller can be always brought into contact with each other. This eliminates a situation where the rocking direction of the swing member and the rotation direction of the roller become opposite to each other, thereby reducing adhesive wear between the contact surface and the roller.

SUMMARY OF THE INVENTION

An aspect of the present invention is the recognition that in the case of the above-described valve mechanism in which the rocker arm is rockably supported by the hydraulic lash adjustor, the hydraulic lash adjustor is complicated in structure and requires a large number of steps for its manufacture or assembly. Thus, the hydraulic lash adjustor is expensive and thus drives up cost. Moreover, since the oil used for the lubrication of the internal combustion engine serves as the working fluid for the hydraulic lash adjustor, reliable operation is often hindered when, during high speed rotation of the internal combustion engine, in particular, air is sucked up into the oil or when the viscosity changes due to the oil temperature.

Accordingly, an object of the present invention is to solve the above-mentioned problems of the prior art and to provide a valve mechanism for an internal combustion engine which is simple in structure and prevents or reduces adhesive wear between the roller and the contact surface from occurring even when the internal combustion engine is rotating at high speed, thereby realizing high level of reliability through secure operation.

Accordingly, one aspect of the present invention comprises a valve drive mechanism for actuating a valve of an internal combustion engine. The valve drive mechanism comprises a cam member with a cam surface having a base circle portion and a lift portion. A roller is configured to rotate and contact the cam surface. The cam member and the roller are configured to reciprocally move relative to each other to open and close the valve. When the roller contacts the base circle portion, a gap for absorbing errors or thermal expansion within the valve drive mechanism exists between components of the valve drive mechanism on a downstream side of a force transmission path to the valve with respect to a contact point between the roller and the cam surface. A spring member brings the roller and the cam surface into constant contact with each other during the relative reciprocating motion between the cam member and the roller.

Another aspect of the present invention comprises a valve drive mechanism for actuating a valve of an internal combustion engine. The valve drive mechanism comprises a camshaft rotated by a crankshaft of the internal combustion engine. A cam is provided on the camshaft. A swing member support shaft is coaxial or in parallel to the camshaft. A swing member is pivotally supported on the swing member support shaft. The swing member is configured to be actuated by the cam for reciprocal motion. A roller follower is configured to be actuated by the swing member for reciprocal motion to open and close the valve. The swing member rocks within a predetermined range about the swing member support shaft. The roller follower reciprocates within a predetermine range in synchronization with the swing member. One of the swing member and the roller follower is provided with a roller for causing the roller follower to move in synchronization with the rocking motion of the swing member. The other member is provided with a contact surface that contacts the roller. The contact surface includes a base circle portion and a lift portion. When the roller contacts the base circle portion, a gap for absorbing errors or thermal expansion of respective portions of the valve drive mechanism system exists between components on a downstream side in a force transmission path with respect to a contact portion between the roller and the cam surface. A spring member brings the roller and the contact surface into constant contact with each other during the reciprocating motion of the swing member and the roller follower Another aspect of the present invention comprises a valve drive mechanism for an internal combustion engine. The mechanism comprises a cam that includes a cam surface having a base circle portion and a lift portion. A roller is configured to contact the cam surface and rotate. The cam and the roller are configured to reciprocally move relative to each other to open and close a valve. When the roller contacts the base circle portion, a gap is provided between the roller and the cam surface. Means are provided for restraining the roller from continuing to rotate due to inertia as the roller and the cam reciprocally move relative to each other Another aspect of the present invention comprises a valve drive mechanism for an internal combustion engine. In the mechanism, a camshaft is rotated by a crankshaft of the internal combustion engine. A cam is provided on the camshaft. A swing member support shaft is positioned coaxially or in parallel to the camshaft. A swing member is pivotally supported on the swing member support shaft and is configured to be pivoted by the cam. A roller follower is configured to be reciprocally moved by the swing member to open and close an intake valve or an exhaust valve of the internal combustion engine. The swing member pivots within a predetermined range about the swing member support shaft. The roller follower reciprocates within a predetermine range in synchronization with the swing member. One of the swing member and the roller follower is provided with a roller for causing the roller follower to operate in synchronization with pivoting motion of the swing member. The other is provided with a contact surface that contacts the roller. A brake is provided and configured to restrain rotation of the roller due to inertia when the contact surface and the roller are not in contact with each other during reciprocating motion of the swing member and the roller follower.

Another aspect of the present invention comprises valve drive mechanism for actuating a valve of an internal combustion engine that includes a cam that is configured for rotation. A roller reciprocates on an upper surface of a rocker arm that is pivoted by a pressing force exerted by the roller during the reciprocating motion to cause the valve to open and close. When the valve is in a closed state, a gap for absorbing errors or thermal expansion of respective portions of a valve mechanism system is provided between the rocker arm and the valve. A spring member brings the roller and the upper surface of the rocker arm into constant contact with each other during relative reciprocating motion between the upper surface of the rocker arm and the roller.

Yet another aspect of the present invention comprises a valve drive mechanism for actuating a valve of an internal combustion engine that includes a cam member with a cam surface having a first portion and a second portion. A roller is configured to rotate and contact the first portion of the cam surface when the valve is in a closed position and the second portion of the cam surface with the valve is in an open position. The cam member and the roller are configured to reciprocally move relative to each other to open and close the valve. When the roller contacts the first portion, a gap within the valve drive mechanism exists between components of the valve drive mechanism on a downstream side of a force transmission path to the valve with respect to a contact point between the roller and the cam surface. A spring member urges the roller and the cam surface into contact with each other during motion between the cam member and the roller For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

A general architecture that implements various features of specific embodiments of the invention will now be described with reference to the drawings. The drawings and the associated descriptions are provided to illustrate embodiments of the invention and not to limit the scope of the invention.

DETAILED DESCRIPTION OF THE PREFERRED EMBODIMENTS

Hereinafter, embodiments of the present invention will be described with reference to the drawings.

Figure 1:
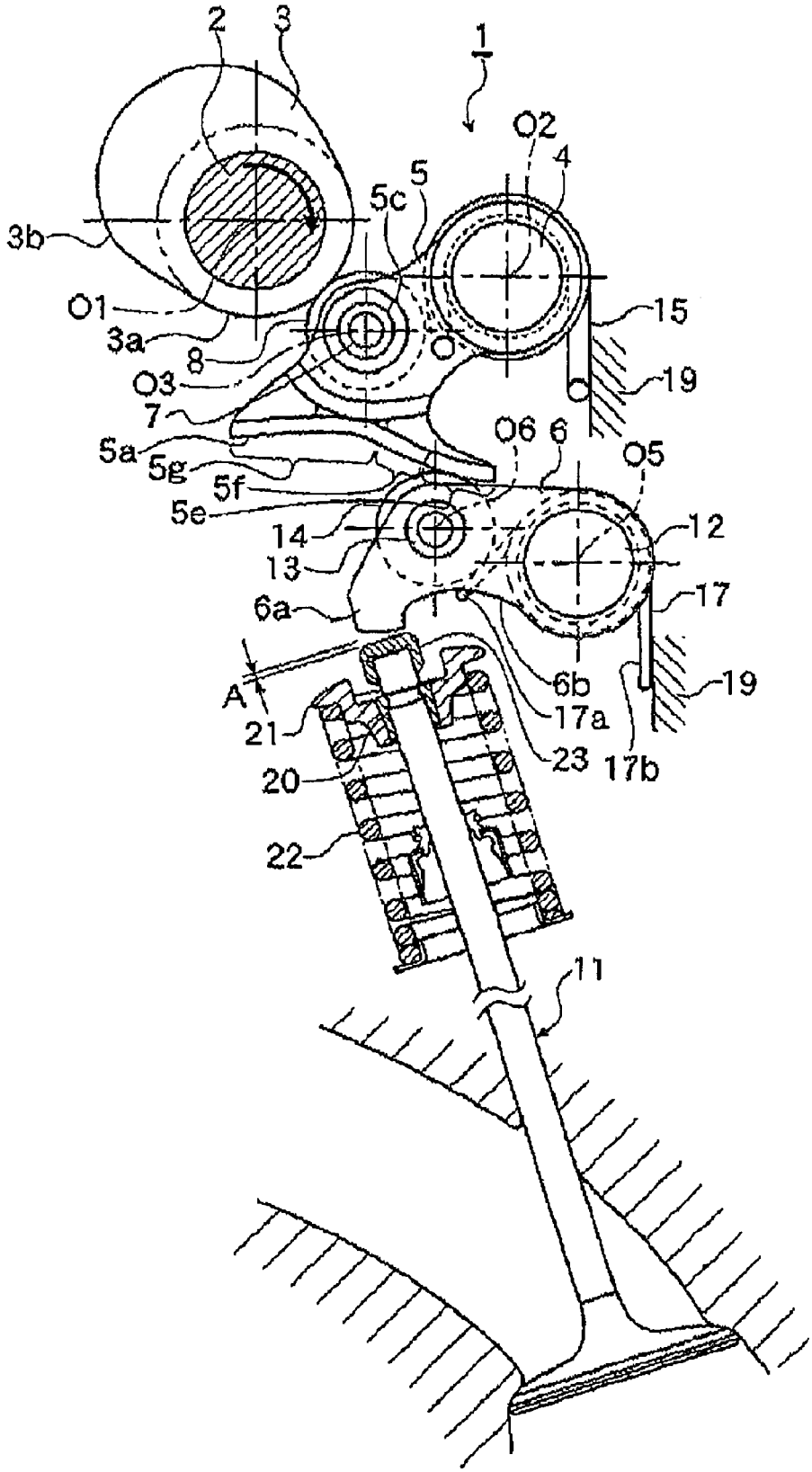
FIG. 1 is a cross-sectional side view of a first embodiment of a valve mechanism when an intake valve is closed.
Figure 2:
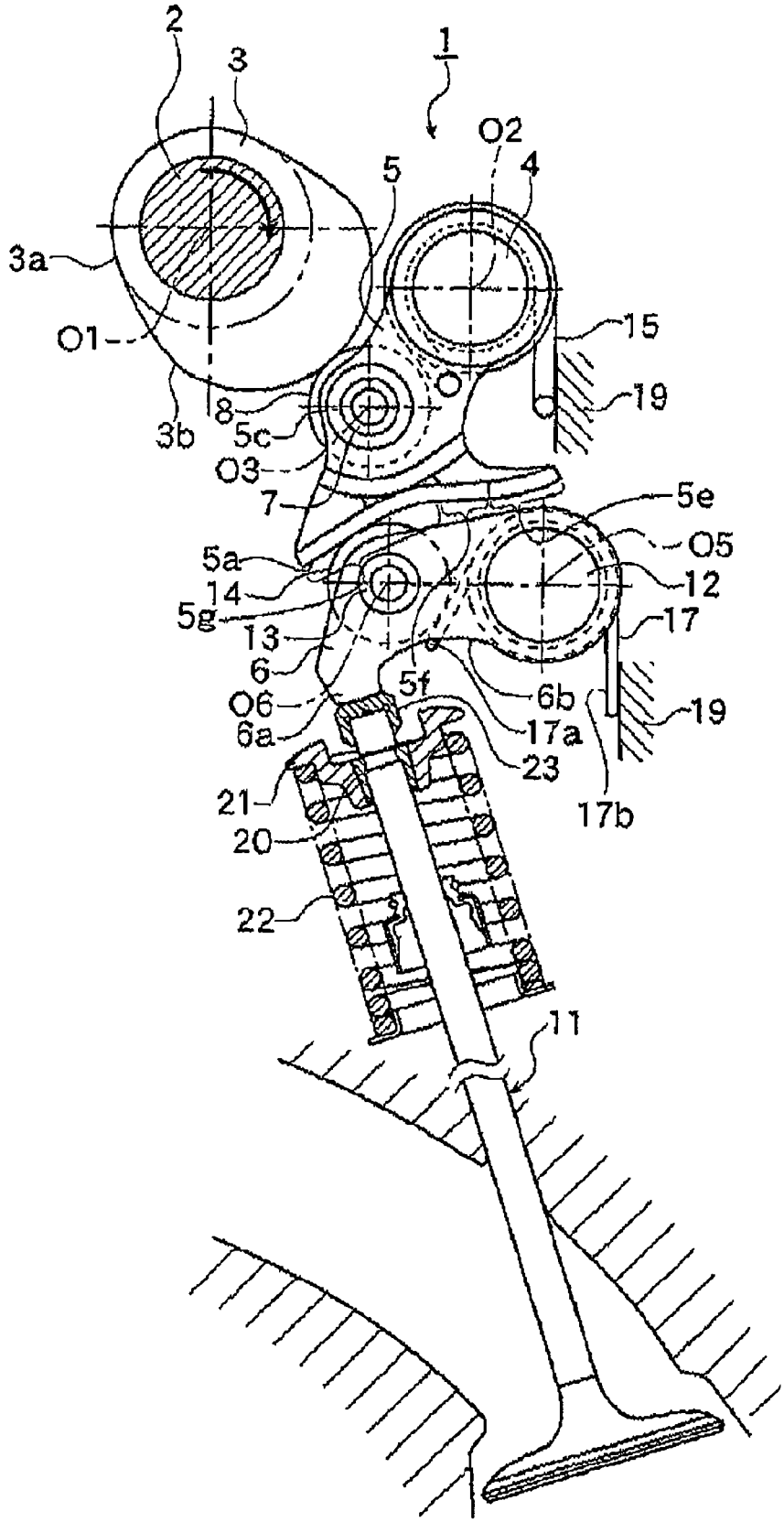
FIG. 2 is a cross-sectional side view of the valve mechanism of FIG. 1 when the intake valve is open.

FIGS. 1 and 2 are views according to a first embodiment of the present invention. FIG. 1 is a cross-sectional side view of a main portion of a valve mechanism for an internal combustion engine, in a state in which an intake valve is closed. FIG. 2 is a cross-sectional side view of the main portion of the valve mechanism for the internal combustion engine, illustrating a state in which the intake valve is open.

In FIG. 1, reference numeral 1 denotes the valve mechanism for an intake valve 11 of the internal combustion engine. The valve mechanism 1 has a camshaft 2, which comprises an elongated "shaft" that is rotated by a crankshaft (not shown) of the internal combustion engine. A rotating cam 3 serves as "drive force transmitting device" that is provided on the camshaft 2. A swing member shaft 4 is provided in parallel to the camshaft 2. A swing member 5 is supported on the swing member shaft 4 and such that it can be freely rocked by the rotating cam 3. A rocker arm 6 can be freely rocked or swung (i.e., can be freely reciprocated) by the swing member 5 and serves as a "cam follower" for opening and closing the intake valve 11 of the internal combustion engine.

In the embodiments described below, reference will be made to the intake valve 11. However, it should be appreciated that certain features and aspects of these embodiments may also be applied to an exhaust valve. It should also be appreciated that various features, aspects and advantages of the present invention may be used with engines having more than one intake valve and/or exhaust valve, and any of a variety of configurations including a variety of numbers of cylinders and cylinder arrangements (V, W, opposing, etc.). In one embodiment, the construction of the valve drive mechanism 1 can be the same or substantially similar between the intake valve 11 and exhaust valve of the engine. Accordingly, the description of the valve drive mechanism herein will focus on the intake valve side and the exhaust valve side will be omitted.

As shown in FIG. 1, the camshaft 2 in the illustrated embodiment is arranged with its longitudinal direction extending toward the front and back (i.e. in the direction perpendicular to the sheet plane) of FIG. 1. The camshaft 2 can be rotated about a center axis O1 at ½ of a rotational speed of that of the crankshaft in the internal combustion engine.

Further, the rotating cam 3 is fixed onto the outer peripheral surface of the camshaft 2 and, as shown in FIG. 1, the outer peripheral portion thereof is configured with a base surface 3*a* that is arc-shaped in plan view, and a nose surface 3*b* projecting from the base surface 3*a*.

A center axis O2 of the swing member shaft 4 can be in parallel to the center axis O1 of the camshaft 2. That is, the swing member shaft 4 can be arranged at a position different from that of the camshaft 2 to be parallel to the camshaft 2.

The swing member 5 can be in fitting engagement with the outer peripheral surface of the swing member shaft 4. The swing member 5 is supported to be rockable or pivotal about the center axis O2 of the swing member shaft 4. In the illustrated embodiment, a contact surface 5*a* is formed in the lower end portion of the swing member 5. As shown, in this embodiment, the contact surface 5*a* is curved in a concave shape on the swing member shaft 4 side. A roller 14 can be provided on rocker arm 6 that will be described later.

With continued reference to FIG. 1, a through-hole 5*c* can be formed in the middle portion of the swing member 5. A roller shaft 7 having a center axis O3 in parallel to the center axis O2 of the swing member shaft 4 can be rotatably provided in the through-hole 5*c*. A roller 8 can be provided on the roller shaft 7 and can be configured to contact and operate in synchronization with the base surface 3*a* or the nose surface 3*b* of the rotating cam 3.

As shown in FIG. 1, the roller 8 can be formed in a circular shape as seen in side view and can be arranged on the outer peripheral surface of the roller shaft 7. The outer peripheral surface of the roller can is capable of sliding on the base surface 3*a* and nose surface 3*b* of the rotating cam 3.

A torsion spring or biasing member 15 for urging the swing member 5 toward the rotating cam 3 side can be provided in fitting engagement with the swing member shaft 4. In the illustrated embodiment, one end of the torsion spring 15 can be locked onto the swing member 5, and the other end thereof can be locked onto a cylinder head main body 19. Thus, the swing member 5 can be urged to the rotating cam 3 side by the urging force of the torsion spring 15, so that the outer peripheral surface of the roller 8 is in constant contact with the base surface 3*a* or nose surface 3*b* of the rotating cam 3, and the swing member 5 rocks within a predetermined range in synchronization with the rotating cam 3.

With continued reference to FIG. 1, the rocker arm 6 can be disposed below the swing member 5 while being rockably or pivotally supported on a rocker arm shaft 12 having a center axis O5 that is in parallel to the center axis O2 of the swing member shaft 4.

The rocker arm 6 can have at its distal end portion a valve pressing portion 6*a* for pressing the upper surface of a shim 23 fitted on the intake valve 11 which will be described later. Further, provided in the middle portion of the rocker arm 6 can be a roller shaft 13 having a center axis O6 in parallel to the center axis O5 of the rocker arm shaft 12.

A roller 14 can be rotatably provided on the roller shaft 13. The outer peripheral surface of the roller 14 can be capable of contacting and sliding on the cam or contact surface 5*a* of the swing member 5. The cam surface 5*a* can have has a base circle portion 5*e*, a lift portion 5*f*, and a ramp portion 5*g* connecting therebetween.

The rocker arm shaft 12 can also have a torsion spring 17 as a "spring member or biasing member" for bringing the roller 14 and the cam surface 5*a* into contact with each other.

The torsion spring 17 can be in fitting engagement with the rocker arm shaft 12. One end 17*a* thereof can be locked onto a lower surface portion 6*b* of the rocker arm 6, and the other end 17*b* can be locked onto the cylinder head main body 19 for urging the rocker arm 6 to the swing member 5 side. Further, the spring force of the torsion spring 17 can be set to a level capable of urging the rocker arm 6 to the swing member 5 side to thereby press the roller 14 against the cam surface 5*a* of the swing member 5 while, when the swing member 5 is rocked, allowing the rocker arm 6 to rock in synchronization with this rocking movement. Thus, the rocker arm 6 can be urged to the swing member 5 side by the urging force of the torsion spring 17, so the outer peripheral surface of the roller 14 is held in constant contact with the cam surface 5*a* of the swing member 5, and the rocker arm 6 rocks within a predetermined range in synchronization with the swing member 5 to make reciprocating motion.

As shown in FIG. 1, the intake valve 11 is arranged such that as it is pressed on by the valve pressing portion 6*a* it is vertically movable below the valve pressing portion 6*a* of the rocker arm 6 at a position where a predetermined gap A is provided in order to prevent the closure of the intake valve 11 due to the thermal expansion of the intake valve 11 caused by an increase in the temperature of the internal combustion engine. As mentioned above, such closure can cause the valve 11 to become unreliable.

When the gap (A) is too large, noise is generated or the intake valve 11 cannot be reliably opened. Further, when the gap (A) is too small, the intake valve 11 cannot be reliably closed due to upward jumping or movement of the valve. Thus, the gap (A) is typically set by taking into account the rocking range of the rocker arm 6, the thermal expansion of the intake valve 11, and the like.

The intake valve 11 can have a collet 20 and an upper retainer 21 that are provided in its upper portion. A valve spring or biasing member 22 can be arranged below the upper retainer 21. The intake valve 11 can be urged toward the rocker arm 6 side by the urging force of the valve spring 22. Further, the shim 23 can be provided for adjusting the valve clearance. The shim 23 can be fitted on the upper end portion of the intake valve 11.

Accordingly, in use, the intake valve 11 can be vertically moved by rocking the rocker arm 6 in synchronization with the rocking motion of the swing member 5, thereby making it possible to open and close the intake valve 11.

Next, the operation of the illustrated embodiment of the valve mechanism 1 constructed as described above will be described in detail with reference to FIGS. 1 and 2. The valve mechanism 1 operates as described below to bring the intake valve 11 from the closed state to the open state.

First, in the valve mechanism 1, the camshaft 2 is rotated by the crankshaft of the internal combustion engine at ½ of a rotational speed of that of the crankshaft. The rotation of the camshaft 2 causes the rotating cam 3 to be rotated in the direction indicated by the arrow in FIG. 1 about the center axis O1 of the camshaft 2.

Further, as shown in FIG. 1, while the roller 8 provided to the swing member 5 is in contact with the base surface 3*a* of the rotating cam 3, the swing member 5 is not rocked to the intake valve 11 side. The rocker arm 6, in turn, is urged to the swing member 5 side by the urging force of the torsion spring 17. The intake valve 11 is urged to the rocker arm 6 side by the urging force of the valve spring 22. Thus, there is no lift on the intake valve 11 so the intake valve 11 is in the closed state.

Then, when the rotating cam 3 is rotated via the camshaft 2 by the crankshaft of the internal combustion engine and, as shown in FIG. 2, the roller 8 is pressed on by the nose surface 3*b*. The swing member 5 is pressed via the roller shaft 7, causing the swing member 5 to rock counterclockwise in FIG. 1 against the urging force of the torsion spring 15.

When the swing member 5 is further rocked counterclockwise (with respect to FIG. 1) the roller 14, which is in contact with the cam surface 5*a* of the swing member 5 due to the urging force of the torsion spring 17, operates in synchronization with the swing member 5 so as to slide on the cam surface 5*a* while rotating clockwise (with respect to FIG. 1) to be pressed to the intake valve 11 side. This causes the rocker arm 6 to be rocked via the roller shaft 13 to the intake valve side against the urging force of the torsion spring 17.

Then, the rocker arm 6 rocked to the intake valve 11 side presses on the upper surface of the shim 22 by the valve pressing portion 6*a* formed at the distal end portion thereof. This pushes down the intake valve 11 to open the intake valve 11. In this way, the rocker arm 6 is urged to the swing member 5 side by the torsion spring 17 and the valve spring 22. The roller 14 of the rocker arm 6 is in constant contact with the cam surface 5*a* of the swing member 5, so the rocking direction of the swing member 5 and the rotation direction of the roller 14 are the same at all times. Thus, the intake valve 11 can be brought into the open state as shown in FIG. 2.

Next, the valve mechanism 1 operates as described below to bring the intake valve 11 from the open state to the closed state. First, in the state where the roller 8 is pressed by the nose surface 3*b* of the rotating cam 3 to bring the intake valve 11 into the opened state as shown in FIG. 2, because of the operation of the valve mechanism 1 as described above, when the rotating cam 3 is rotated via the camshaft 2 by the crankshaft of the internal combustion engine, as shown in FIG. 1, this causes the roller 8 of the swing member 5 previously located on the nose surface 3*b* of the rotating cam 3 to slide on the base surface 3*a*. Then, due to the urging force of the torsion spring 15, with the roller 8 being held in contact with the rotating cam 3, the rocking direction of the swing member 5 is reversed so that the swing member 5 is rocked clockwise in FIG. 1.

Then, when the swing member 5 is reversed in its rocking direction to rock clockwise in FIG. 1, the rocker arm 6 is rocked to the swing member 5 side with the roller 14 being held in contact with the cam surface 5*a* of the swing member 5 by the urging force of the torsion spring 17. Since the roller 14 is in contact with the cam surface 5*a* of the swing member 5 at this time, simultaneously with the reversing of the rocking direction of the swing member 5, the rotation of the roller 14 is reversed from the clockwise rotation in FIG. 1 to the counterclockwise rotation in FIG. 1, causing the roller 14 to roll on the cam surface 5*a*.

Then, when the rocker arm 6 is rocked to the swing member 5 side, the intake valve 11 is urged to the rocker arm 6 side by the urging force of the valve spring 22, causing the intake valve 11 to be closed. In this way, the rocker arm 6 is urged to the swing member 5 side by the torsion spring 17, and the roller 14 of the rocker arm 6 is in constant contact with the cam surface 5*a* of the swing member 5, so the rocking direction of the swing member 5 and the rotation direction of the roller 14 are the same at all times, and the intake valve 11 can be brought into the closed state as shown in FIG. 1.

Since the roller 14 is held in constant contact with the cam surface 5*a* of the swing member 5 by the torsion spring 17, and the rocking direction of the swing member 5 and the rotation direction of the roller 14 are made to be the same at all times, it is possible to prevent adhesive wear from occurring due to the reversing of the rocking direction of the swing member 5 and of the rotation direction of the roller 14.

That is, conventionally, when the valve state shifts from the open state to the closed state, and the roller is moved up to the base circle portion, if a gap is present between the roller and the base circle portion, the roller continues to rotate in a predetermined direction. Then, as the valve state shifts to the valve open state from this state, the roller abuts the ramp portion and the above-mentioned rotation is stopped. At the same time, the roller is rapidly rotated in the reverse direction. As a result, adhesive wear occurs.

In contrast, according to the illustrated embodiment, even when a change occurs from the valve open state as shown in FIG. 2, in which the roller 14 is pressed on by the lift portion 5*f* of the swing member 5, to the valve closed state as shown in FIG. 1 in which the roller 14 has moved to the base circle portion 5*e* of the swing member 5, the torsion spring 17 allows the roller 14 to move while being in constant contact with the base circle portion 5*e*. Further, the gap (A) is adapted to be present at a downstream-side portion, that is, between the valve pressing portion 6*a* of the rocker arm 6 and the intake valve 11 in this case. Thus, unlike in the prior art, the roller 14 does not keep rotating in a predetermined direction by inertia in this valve's closed state. Then, when the valve shifts from the closed state to the open state again, as the roller 14 moves from the base circle portion 5*e* to the lift portion 5*f* via the ramp portion 5*g*, the roller 14 rolls from a position on the base circle portion 5*e* onto the life portion 5*f*. Thus, the roller 14 does not undergo rapid reverse rotation as it moves from the base circle portion 5*e* to the lift portion 5*f* as is the case with the related art, thereby making it possible to prevent adhesive wear from occurring.

It should be noted that while, in the illustrated embodiment, the roller 14 is provided on the rocker arm 6, and the cam surface 5*a* with which the roller 14 comes into contact is formed in the lower end portion of the swing member 5; modified embodiments of the present invention are not limited to this construction. Also in the case where the roller 14 is provided to the lower end portion of the swing member 5, and the cam surface 5*a* with which the roller 14 comes into contact is formed in the upper end portion of the rocker arm 6, the rocker arm 6 can be rocked by the swing member 5 without adhesive wear occurring between the roller 14 and the cam surface 5*a*.

In the illustrated valve mechanism 1, the swing member 5, which makes reciprocating motion while rocking within a predetermined range about the swing member shaft 4, can be provided with the cam surface 5*a* with which the roller 14 comes into contact. The rocker arm 6, which makes reciprocating motion while rocking within a predetermined range in synchronization with the swing member 5, can be provided with the roller 14 for operating the rocker arm 6 in synchronization with the rocking motion of the swing member 5. Further, in the illustrated embodiment, the valve mechanism 1 can be provided the torsion spring 17 for bringing the roller 14 and the cam surface 5*a* into constant contact with each other during the reciprocating motion of the swing member 5 and rocker arm 6. Thus, it is not necessary to use a hydraulic lash adjustor as is conventionally used. Accordingly, adhesive wear between the roller 14 and the cam surface 5*a* can be prevented or reduced by a simple, less complex structure. Thus, even when the internal combustion engine is rotating at high speed, thereby making it possible to achieve high level of reliability through secure operation.

Advantageously, the torsion spring 17 is in fitting engagement with the rocker arm shaft 12 that rockably supports the rocker arm 6, with the one end 17*a* thereof being locked onto the rocker arm 6 and the other end 17*b* being locked onto the cylinder head main body 19. The spring 17 urges the rocker arm 6 to the swing member 5 side. Accordingly, the valve mechanism can be simplified in structure to achieve a reduction in cost. Further, since the torsion spring 17 is provided to the valve mechanism 1 while in fitting engagement with the rocker arm shaft 12, the assembly process can be simplified, thereby achieving compact construction of the valve mechanism 1.

It should be noted that while in the illustrated embodiment the rotating cam 3 of the camshaft 2 is used as the "drive force transmitting device," this should not be construed restrictively. For example, the drive force from a shaft not provided with the rotating cam 3 may be transmitted to the swing member 5 via a link. Further, while the rocker arm 6 is used as the "cam follower" in the illustrated embodiment, the rocker arm 6 may not be used and the drive force from the swing member 5 may be directly transmitted to the valve 11 side via the roller 8.

Figure 3:
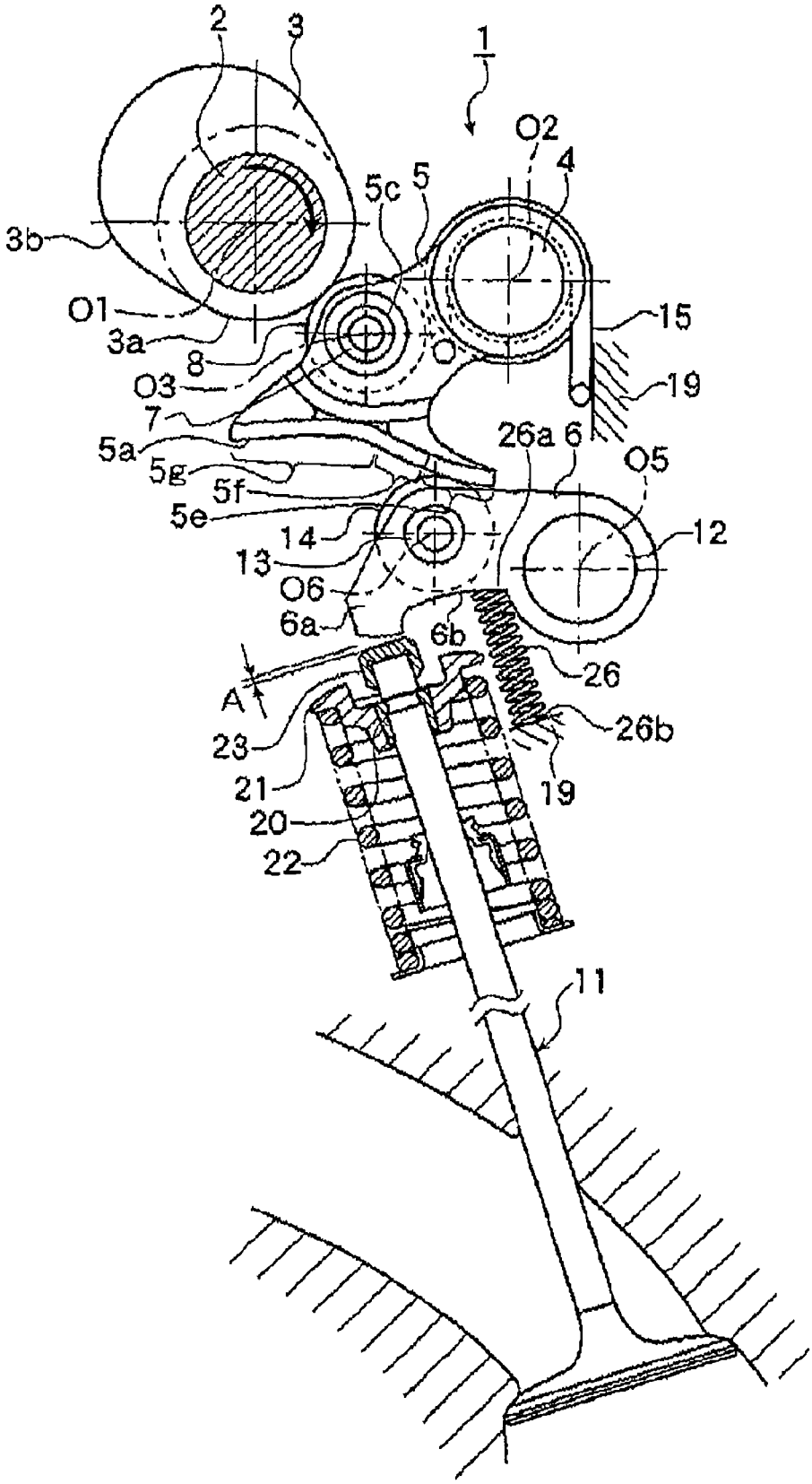
FIG. 3 is a cross-sectional side view of a second embodiment of a valve mechanism when the intake valve is closed.
Figure 4:
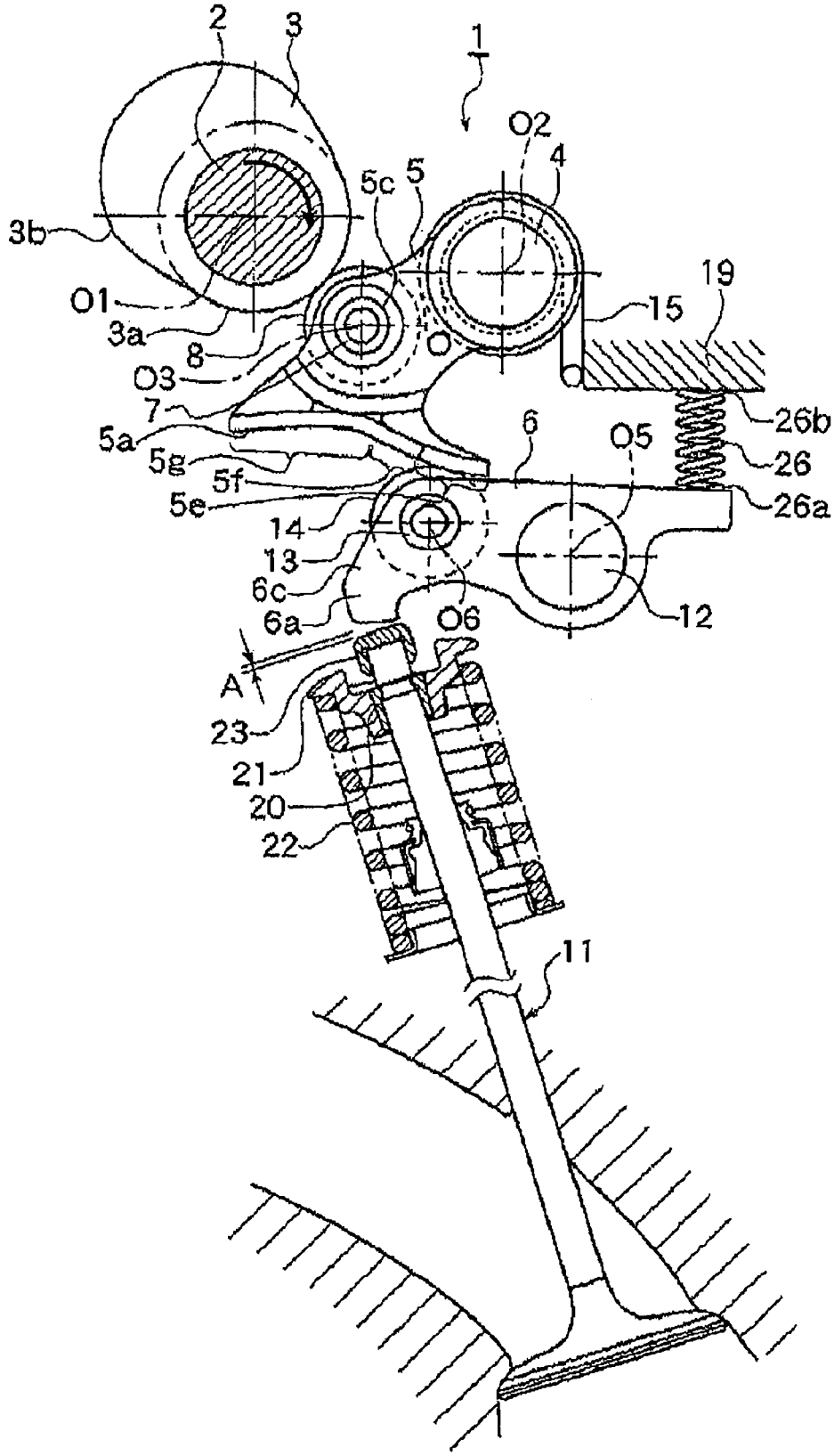
FIG. 4 is a cross-sectional side view of a modified embodiment of the valve mechanism of FIG. 3 when the intake valve is closed.

FIGS. 3 and 4 are cross-sectional side views of a main portion of a valve mechanism for an internal combustion engine according to second embodiment. In these figures, the intake valve is in a closed position.

In this embodiment, unlike the spring member used in the embodiment described above, a biasing member (e.g., a coil spring) 26 can be provided between the rocker arm 6 and the cylinder head main body 19. The spring 26 is used to urge the rocker arm 6 to the swing member 5 side to bring the roller 14 provided on the rocker arm 6 and the cam surface 5*a* of the swing member 5 into contact with each other.

Specifically, as shown in FIG. 3, the coil spring 26 is arranged to be substantially in parallel to the intake valve 11. One end 26*a* thereof can be locked onto the lower surface portion 6*b* of the rocker arm 6, and the other end 26*b* can be locked onto the cylinder head main body 19. The coil spring 26 urges the rocker arm 6 to the swing member 5 side. Further, as in the first embodiment, the spring force of the coil spring 26 can be set to a level capable of urging the rocker arm 6 to the swing member 5 side an to press the roller 14 against the cam surface 5*a* of the swing member 5 and, when the swing member 5 is rocked, to allow the rocker arm 6 to rock in synchronization with this rocking movement. Thus, the rocker arm 6 can be urged to the swing member 5 side by the urging force of the coil spring 26, so the outer peripheral surface of the roller 14 is held in constant contact with the cam surface 5*a* of the swing member 5.

It should be noted that, while in the embodiment of FIG. 3, the coil spring 26 is provided between the lower surface portion 6*b* of the rocker arm 6 and the cylinder head main body 19, modified embodiments of the invention are not limited to this construction. For example, as shown in FIG. 4, the rocker arm 6 can be formed in the shape of a seesaw that rocks about the rocker arm shaft 12, and, as described above. The valve pressing portion 6*a* can formed at the distal end portion of one end portion 6*c* of the rocker arm 6, with the roller shaft 13 and the roller 14 being provided between the valve pressing portion 6*a* and the rocker arm shaft 12. As shown, by providing the coil spring 26 between the upper surface portion of the other end portion 6*d* and the cylinder head main body 19, with the one end 26*a* thereof being onto the upper surface portion of the rocker arm 6 and the other end 26*b* thereof being locked onto the cylinder head main body 19, the rocker arm 6 is urged to the swing member 5 side, thereby making it possible to bring the roller 14 provided to the rocker arm 6 into contact with the cam surface 5*a* of the swing member 5.

It should be appreciated that while the valve mechanism 1 for an internal combustion engine constructed as described above uses the coil spring 26 that is different from the spring member according to the first embodiment, a substantially similar urging force acts on the roller 14 in the same direction as that in the first embodiment. Thus, since the second embodiment is of the substantially same operation as of the first embodiment in this regard, description of the operation of the second embodiment will be omitted.

Further, in this second embodiment, since the spring member has the coil spring 26 provided between the rocker arm 6 and the cylinder head main body 19 and urging the rocker arm 6 to the swing member 5 side, the roller 14 and the cam surface 5*a* can be brought into contact with each other by simply arranging the coil spring 26 between the rocker arm 6 and the cylinder head main body 19, whereby the assembly process for the valve mechanism 1 can be simplified.

Figure 5:
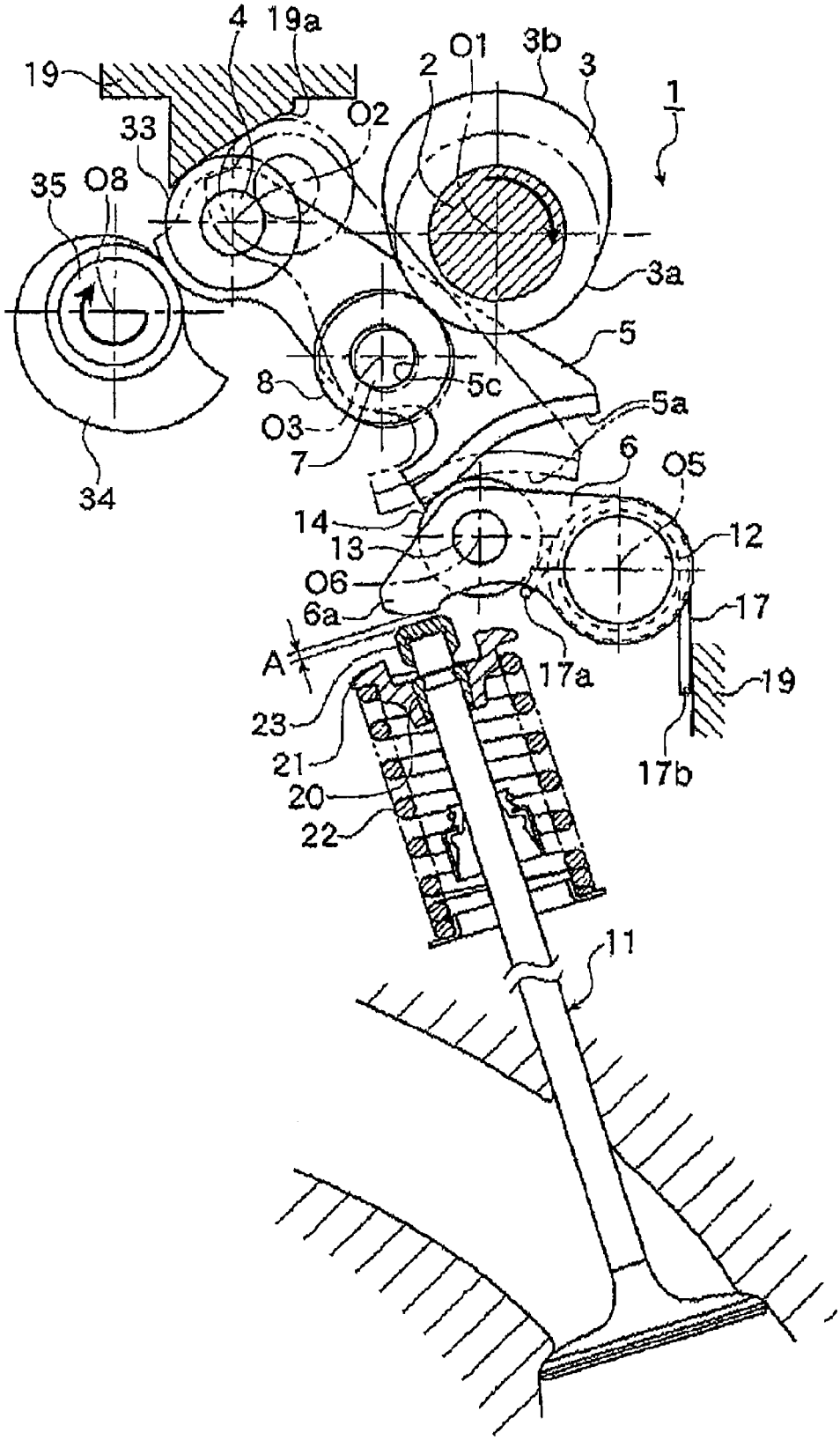
FIG. 5 is a cross-sectional side view of a third embodiment of a valve mechanism when the intake valve is closed.

FIG. 5 is a cross-sectional side sectional view of the main portion of a third embodiment valve mechanism for an internal combustion engine. In this figure, the valve is shown in a closed state.

In this embodiment, the valve mechanism 1 is capable of adjusting the lift amount or the like of each valve by making the swing member shaft 4 movable to a predetermined position.

Specifically, as shown in FIG. 5, a roller 33 can be arranged on the outer peripheral surface of the swing member shaft 4. The roller 33 can be in contact with a guide portion 19*a* formed in the cylinder head main body 19 for guiding the swing member shaft 4 to a predetermined position. Further, the swing member shaft 4 can be provided to the cylinder head main body 19 such that, when the swing member 5 is pressed by a control cam 34 that will be described below, the swing member shaft 4 can move in synchronization with the swing member 5 within a range from a position indicated by the solid line in FIG. 5 to that indicated by the chain double-dashed line in FIG. 5.

The control cam 34 can be fixed onto the outer peripheral surface of a control shaft 35 provided in parallel to the camshaft 2. Further, in this embodiment, the outer peripheral portion of the control cam 34 contacts the swing member 5 and is formed in a configuration allowing the swing member shaft 4 to be guided to a predetermined position by rotating the control cam 34 in a predetermined angle.

Further, an actuator (not shown) for rotating the control shaft 35 can be provided within a predetermined angle range about a center axis O8 of the control shaft 35 and can be connected to one end portion of the control shaft 35. Connected to the actuator can be a control device (not shown) for controlling the angle of the actuator according to the operational state of the internal combustion engine.

With continued reference to FIG. 5, the rocker arm 6, which makes reciprocating motion while rocking within a predetermined range in synchronization with the swing member 5, can be of the substantially same construction as that of the embodiment of FIG. 1. That is, the rocker arm 6 can have the valve pressing portion 6*a* formed therein and can be provided with the roller shaft 13 and the roller 14, and be rockably supported on the rocker arm shaft 12.

Further, as in the first embodiment, the rocker arm shaft 12 can be provided with the torsion spring 17 as a spring member for bringing the roller 14 and the cam surface 5*a* into constant contact with each other.

Thus, in this embodiment, when the control shaft 35 is turned by a predetermined angle by the actuator, the control cam 34 is rotated by a predetermined angle about the center axis O8 of the control shaft 35. Further, when the control cam 34 is rotated by the predetermined angle, by the control cam 34, the roller 33 is caused via the swing member 5 to slide on the guide portion 19*a* of the cylinder main body so as to be moved, for example, from the position indicated by the solid line in FIG. 5 to a predetermined position indicated by the chain double-dashed line in FIG. 5. Then, as the swing member shaft 4 is moved, the position of the cam surface 5*a* of the swing member 5 changes. The rocking amount of the rocker arm 6 can be thus changed, which makes it possible to adjust the lift amount or the like of the intake valve 11 that is vertically moved by the rocker arm 6.

It should be noted that while in this embodiment the roller 14 and the cam surface 5*a* are brought into contact with each other by using the same torsion spring 17 as that of the first embodiment as the spring member, this should not be construed restrictively. For instance, as the same or substantially same spring member as that of the second embodiment (e.g. the coil spring 26) can be used to bring the roller 14 and the cam surface 5*a* into contact with each other.

Also with the valve mechanism 1 constructed as described above, which makes the lift amount or the like of each valve variable by moving the swing member shaft 4 to a predetermined position, the rocker arm 6 can be urged to the swing member 5 side by the torsion spring 17. Thus, even when the swing member shaft 4 has been moved to the predetermined position, and the position of the cam surface 5*a* of the swing member 5 changes, the roller 14 of the rocker arm 6 and the cam surface 5*a* of the swing member 5 come into contact with each other. Adhesive wear can be thus prevented.

Figure 6:
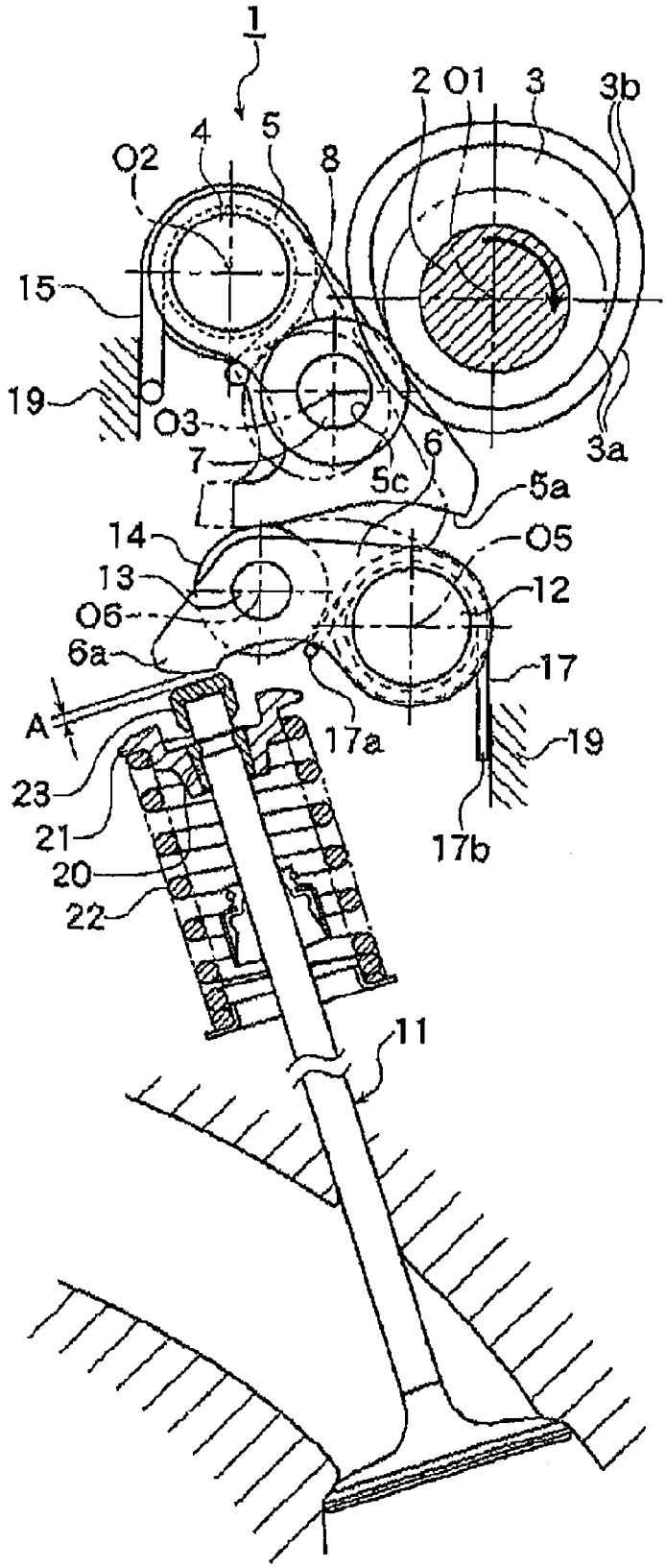
FIG. 6 is a cross-sectional side view of a forth embodiment of a valve mechanism when the intake valve is closed.

FIG. 6 is a cross-sectional side view of a fourth embodiment of a valve mechanism for an internal combustion engine. In this figure, the valve is shown in a closed state.

In this embodiment, the valve mechanism 1 is configured such that the rotating cam 3 has a tapered configuration. Thus, the contact position between the outer peripheral portion of the rotating cam 3 and the swing member 5 is can be adjusted by moving the rotating cam 3 in the direction of the center axis O1 of the camshaft 2. This makes it possible to adjust the lift amount or the like of each valve.

Specifically, as shown in FIG. 6, the rotating cam 3 can be fixed onto the outer peripheral surface of the camshaft 2. The outer peripheral portion of the rotating cam 3 can be construction with the base surface 3*a* that is arc-shaped in plan view, and the nose surface 3*b* projecting from the base surface 3*a*. Further, the rotating cam 3 can be tapered as it extends toward the front and back (i.e. in the direction perpendicular to the sheet plane) of FIG. 6. That is, the base surface 3*a* and nose surface 3*b* of the outer peripheral portion of the rotating cam 3 are inclined with respect to the center axis O1 of the camshaft 2.

Further, an actuator (not shown) can be provided for moving the camshaft 2 within a predetermined range in the direction of the center axis O1 is connected to one end portion of the camshaft 2. Connected to the actuator is control device (not shown) for controlling the angle of the actuator according to the operational state of the internal combustion engine.

Further, the outer peripheral surface of the roller 8 can be provided on the swing member 5 rocked by the rotating cam 3 and can be capable of sliding on the base surface 3*a* and nose surface 3*b* of the rotating cam 3 formed in the tapered configuration.

The rocker arm 6, which makes reciprocating motion while rocking within a predetermined range in synchronization with the swing member 5, can be of the substantially same construction as that of the first embodiment. That is, the rocker arm 6 can have the valve pressing portion 6*a* formed therein and can be provided with the roller shaft 13. The roller 14 can be rockably supported on the rocker arm shaft 12.

Further, as in the first embodiment, the rocker arm shaft 12 can be provided with the torsion spring 17 as a spring member for bringing the roller 14 and the cam surface 5*a* into constant contact with each other. Thus, when the camshaft 2 moves within a predetermined range in the direction of the center axis O1 by the actuator, the rotating cam 3 moves within a predetermine range in the direction of the center axis O1 of the camshaft 2. Further, since the rotating cam 3 is formed in the tapered configuration, when the rotating cam 3 is moved with the predetermined range, the swing member 5 is caused via the roller shaft 7 and the roller 8 to move, for example, from the position indicated by the solid line in FIG. 6 to a predetermined position indicated by the double-dashed chain line in FIG. 6. Then, when the swing member 5 has been moved to the predetermined position, the position of the cam surface 5*a* of the swing member 5 changes. Therefore, the rocking amount of the rocker arm 6 can be changed, which makes it possible to adjust the lift amount or the like of the intake valve 11 that is vertically moved by the rocker arm 6.

It should be noted that while in the illustrated embodiment the roller 14 and the cam surface 5*a* are brought into contact with each other by using the substantially the same torsion spring 17 as that of the first embodiment, this should not be construed restrictively. For instance, the substantially same spring member as that of the second embodiment (i.e., the coil spring 26) can be used to bring the roller 14 and the cam surface 5*a* into contact with each other.

Also with the valve mechanism 1 constructed as described above, in which the rotating cam 3 is tapered, and the lift amount or the like of each valve variable is made variable by moving the rotating cam 3 in the direction of the center axis O1 of the camshaft 2 and changing the contact position between the outer peripheral portion of the rotating cam 3 and the swing member 5, the rocker arm 6 is urged to the swing member 5 side by the torsion spring 17. Thus, even when the swing member shaft 4 has been moved to the predetermined position, and the position of the cam surface 5*a* of the swing member 5 changes, the roller 14 of the rocker arm 6 and the cam surface 5*a* of the swing member 5 come into contact with each other. Adhesive wear can be thus prevented and/or reduced.

Figure 7:
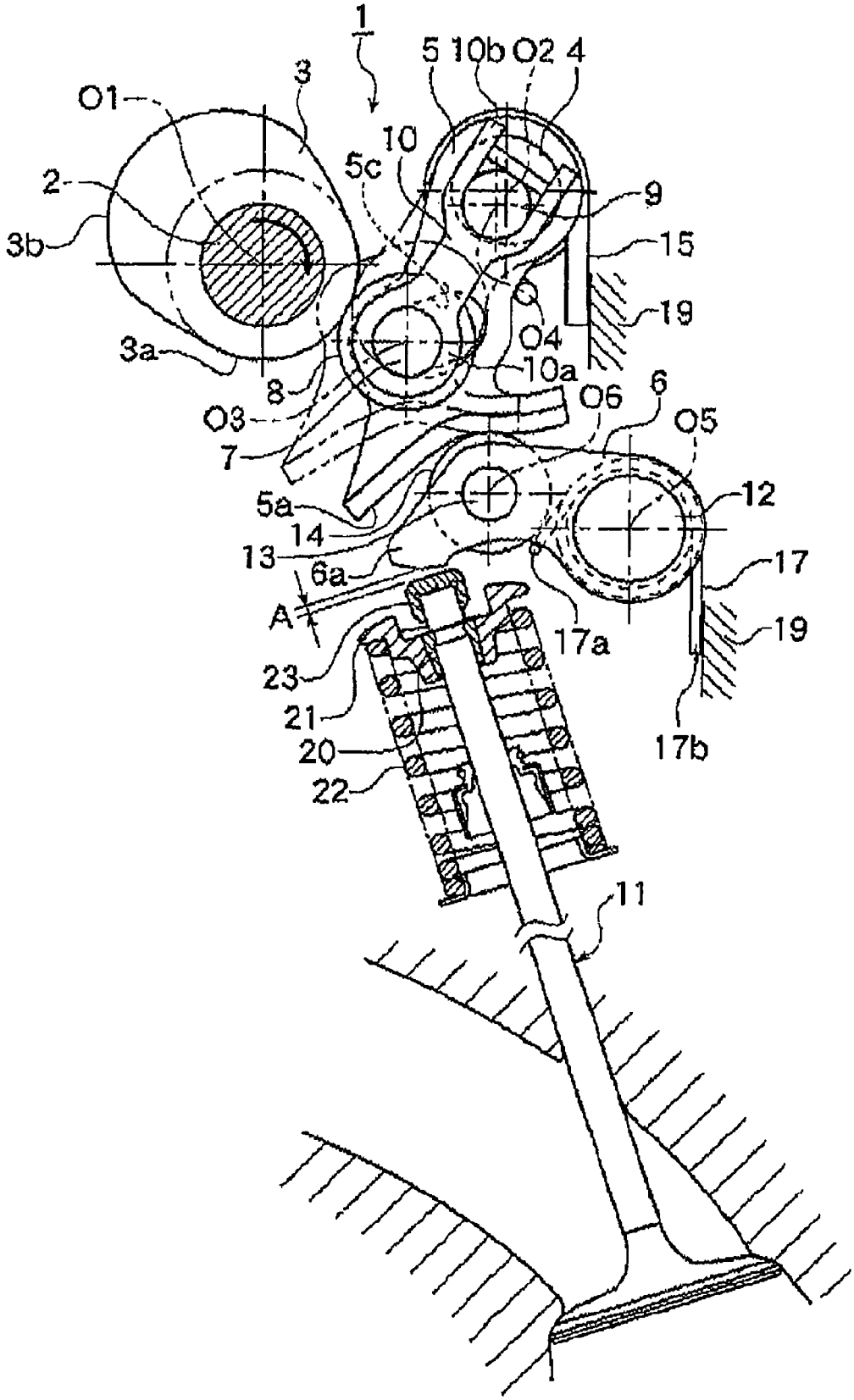
FIG. 7 is a cross-sectional side view of a fifth embodiment of a valve mechanism when the intake valve is closed.

FIG. 7 is a cross-sectional side view of a fifth embodiment of valve mechanism for an internal combustion engine. Again, the valve 11 is shown in a closed position.

In the valve mechanism 1 according to this embodiment, the roller shaft 7 can be provided on the swing member 5 with the roller 8 that comes into contact with the rotating cam 3. The roller 8 can be moved within a predetermined range to make the relative distance between the center axis O3 of the roller shaft 7 and the center axis O2 of the swing member shaft 4 variable. This makes it possible to adjust the lift amount or the like of each valve.

Specifically, as shown in FIG. 7, the through-hole 5*c* through which the roller shaft 7 of the swing member 5 is penetrated is formed along the longitudinal direction of the roller shaft 7 so as to guide the roller shaft 7 over a predetermined distance. The guiding direction can be inclined with respect to the radial direction of the camshaft 2.

Further, the valve mechanism 1 is provided with a variable roller mechanism for guiding the roller shaft 7 inserted through the through-hole 5*c* over a predetermined distance. The variable abutment portion mechanism can have an eccentric shaft 9 fixedly provided onto the swing member shaft 4, and an arm 10 whose one end portion 10*a* is connected to the roller shaft 7 and the other end portion 10*b* is connected to the eccentric shaft 9.

The eccentric shaft 9 can be provided on the swing member shaft 4 in such a manner that a center axis O4 thereof is located in parallel and eccentrically to the center axis O2 of the swing member shaft. Further, an actuator (not shown) for rotating the swing member shaft 4 within a predetermined angle range about the center axis O2 can be connected to one end portion of the swing member shaft 4. Connected to the actuator can be a control device (not shown) for controlling the angle of the actuator according to the operational state of the internal combustion engine.

The arm 10 can be formed in a configuration allowing the distance between the center axis O3 of the roller shaft 7 and the center axis O4 of the eccentric shaft 9 to be kept constant. Thus, when the swing member shaft 4 is rotated by a predetermined angle by the actuator, the eccentric shaft 9 provided on the swing member shaft 4 is turned by a predetermined angle about the center axis O2 of the swing member shaft. The roller shaft 7 is operated in synchronization with this turning movement through the arm 10. Then, by the arm 10, the roller shaft 7 can be moved within the guide portion 5*b* while keeping the distance between the center axis O3 of the roller shaft 7 and the center axis O4 of the eccentric shaft 9 constant. Thus, the relative distance between the center axis O2 of the swing member shaft 4 and the center axis O3 of the roller shaft 7 can be made variable.

The rocker arm 6, which makes reciprocating motion while rocking within a predetermined range in synchronization with the swing member 5, can of the same construction as that of the first embodiment. That is, the rocker arm 6 can have the valve pressing portion 6*a* formed therein and can be provided with the roller shaft 13. The roller 14 can be rockably supported on the rocker arm shaft 12.

Further, as in the first embodiment, the rocker arm shaft 12 can be provided with the torsion spring 17 as a spring member for bringing the roller 14 and the cam surface 5*a* into constant contact with each other. Thus, when the roller shaft 7 moves within a predetermined range, the relative distance between the center axis O3 of the roller shaft 7 and the center axis O2 of the swing member shaft 4 can be made variable. Thus, the swing member 5 is moved, for example, from the position indicated by the solid line in FIG. 7 to a predetermined position indicated by the chain double-dashed line in FIG. 7. Then, when the swing member 5 has been moved to the predetermined position, the position of the cam surface 5*a* of the swing member 5 changes. The rocking amount of the rocker arm 6 can be thus changed, which makes it possible to adjust the lift amount or the like of the intake valve 11 that is vertically moved by the rocker arm 6.

It should be noted that while in this embodiment the roller 14 and the cam surface 5*a* are brought into contact with each other by using the same torsion spring 17 as that of the first embodiment, this should not be construed restrictively. For instance, as the same spring member as that of the second embodiment (the coil spring 26) can be used to bring the roller 14 and the cam surface 5*a* into contact with each other.

Also with the valve mechanism 1 constructed as described above, in which the roller shaft 7 is moved within the predetermined range to make the relative distance between the center axis O3 of the roller shaft 7 and the center axis O2 of the swing member shaft 4 variable. This makes the lift amount or the like of each valve variable. The rocker arm 6 is urged to the swing member 5 side by the torsion spring 17. Thus, even when the swing member shaft 4 has been moved to the predetermined position, and the position of the cam surface 5*a* of the swing member 5 changes, the roller 14 of the rocker arm 6 and the cam surface 5*a* of the swing member 5 come into contact with each other. Adhesive wear can be thus prevented.

Figure 8:
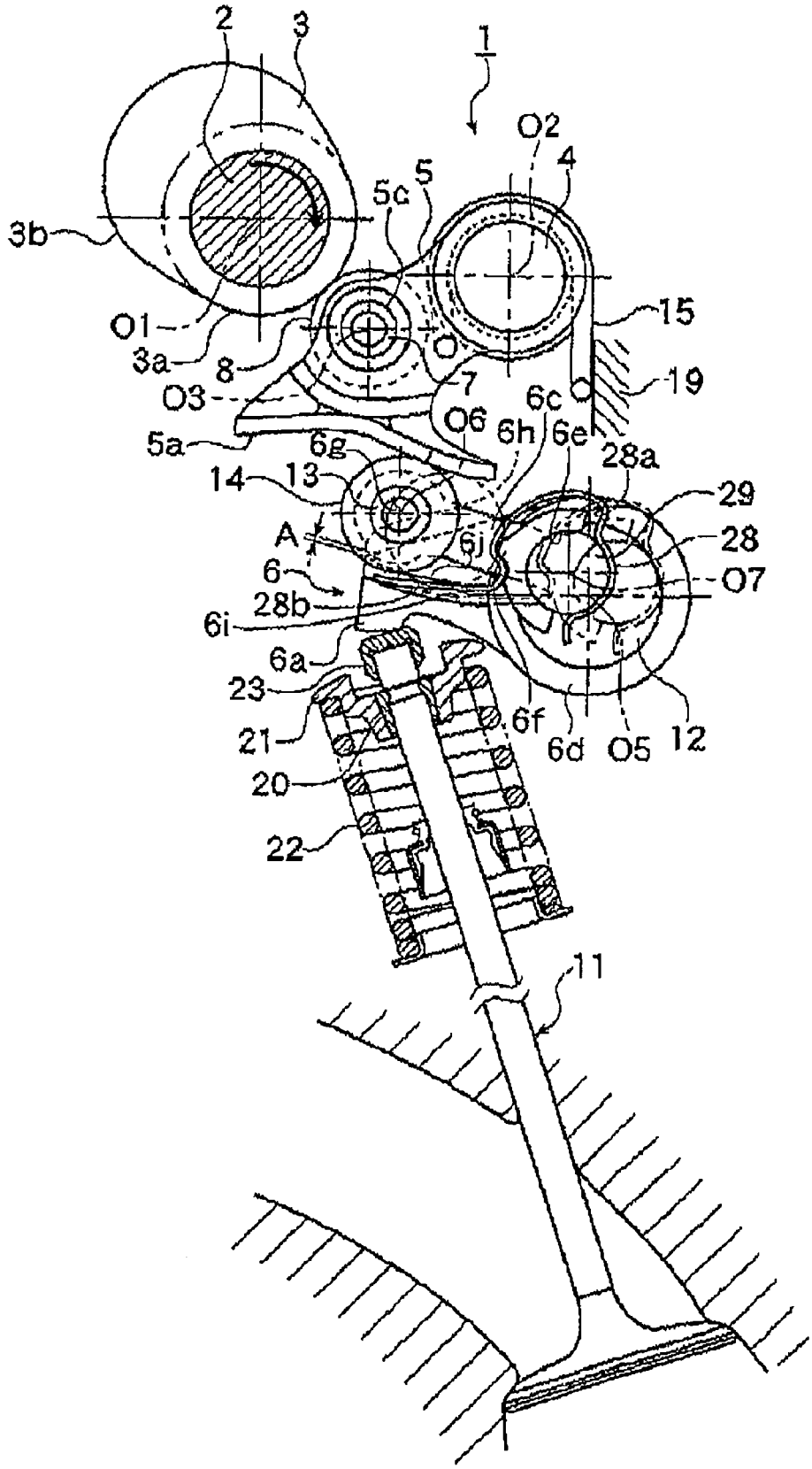
FIG. 8 is a cross-sectional side view of a sixth embodiment of a valve mechanism when the intake valve is closed.

FIG. 8 is a cross-sectional side view of a sixth embodiment of a valve mechanism for an internal combustion engine. Again, the valve is shown in a closed state.

In this embodiment, the rocker arm 6 serving as a "valve pressing member" is provided with the roller 14 that comes into contact with the cam surface 5*a* of the swing member 5. The rocker arm 6 has a roller arm 6*c* as a "roller supporting member" operated in synchronization with the rocking motion of the swing member 5. A rocker arm main body 6*d* rocks in synchronization with the roller arm 6*c* to vertically move the intake valve 11. Further, unlike the spring member used in the first embodiment, a leaf spring 28 can be used to urge the roller arm 6*c* to the swing member 5 side to bring the roller 14 and the cam surface 5*a* of the swing member 5 into contact with each other. Further, by making the roller arm 6*c* movable to a predetermined position to change the contact position between the roller 14 provided to the roller arm 6*c* and the cam surface 5*a* of the swing member 5, whereby the valve mechanism 1 for an internal combustion engine according to this embodiment can adjust the lift amount or the like of each valve.

Specifically, as shown in FIG. 8, an eccentric shaft 29 can be fixedly provided to the rocker arm shaft 12 to serve as a "pivot shaft" in such a manner that a center axis O7 thereof is located in parallel and eccentrically to the center axis O5 of the rocker arm shaft 12. The roller arm 6*c* of the rocker arm 6 can be rotatably locked onto the eccentric shaft 29 by the leaf spring 28.

The roller arm 6*c* can have an engaging portion 6*e* formed at its one end. The engaging portion 6*e* can engage with the outer peripheral surface of the eccentric shaft 29, and can be so shaped as to be capable of sliding on the outer peripheral surface of the eccentric shaft 29. Further, formed at a position adjacent to the engaging portion 6*e* is a fitting engagement portion 6*f* with which the leaf spring 28 for integrally locking the roller arm 6*c* and the eccentric shaft 29 in place is brought into fitting engagement so as to prevent dislodging thereof. Further, a through-hole 6*g*, with which the roller shaft 13 supporting the roller 14 that slides on the cam surface 5*a* of the swing member 5 is brought into fitting engagement, is formed at the other end of the roller arm 6*c*. Formed below the through-hole 6*g* can be a pressing portion 6*h* for pressing the rocker arm main body 6*d* to the intake valve 11 side when the roller arm 6*c* rocks to the intake valve 11 side in synchronization with the rocking motion of the swing member 5.

With continued reference to FIG. 8, the rocker arm main body 6*d* of the rocker arm 6 can be rockably supported and arranged on the rocker arm shaft 12. The valve pressing portion 6*a* can be formed at is distal end portion. The valve pressing portion 6*a* presses on the upper surface of the shim 23 fitted on the intake valve 11. Further, a contact surface 6*i* with which a distal end portion 28*b* of the leaf spring 28, which will be described later, comes into contact is formed above the valve pressing portion 6*a*, and a pressing surface 6*j* pressed on by the pressing portion 6*h* formed in the rocker arm 6*c* is formed above the contact surface 6*i*.

The leaf spring 28 as a spring member can be formed into a predetermined configuration by bending a planar spring at several locations. More specifically, the leaf spring 28 can be formed in a configuration allowing fitting engagement with the fitting engagement portion 6*f* of the roller arm 6*c* and with the eccentric shaft 29, and can have formed therein a locking portion 28*a* for integrally locking the roller arm 6*c* and the eccentric shaft 29 onto each other. Further, the distal end portion 28*b* on the roller arm 6*c* side can extend to the rocker arm main body 6*d* side and can come into contact with the contact surface 6*i* formed in the rocker arm main body 6*d*. Further, the leaf spring 28 is formed in such a configuration as to urge the roller arm 6*c* and the rocker arm main body 6*d* to spread out from each other when the roller arm 6*c* and the eccentric shaft 29 are integrally locked onto each other by the locking portion 28*a*.

With continued reference to FIG. 8, the predetermined gap (A) is provided between the valve pressing portion 6*a* of the roller arm 6*c* and the pressing surface 6*j* of the rocker arm main body 6*d*. The gap (A) is the same as the gap (A) of the first embodiment provided between the valve pressing portion 6*a* and the intake valve 11.

Thus, since the roller arm 6*c* is integrally locked onto the eccentric shaft 29 by the leaf spring 28 so that the roller arm 6*c* can slide on the outer peripheral surface of the eccentric shaft 29, when the swing member 5 is rocked, the roller arm 6*c* is caused via the roller 14 and the roller shaft 13 to rock to the intake valve 11 side against the urging force of the leaf spring 28. Further, as the rocker arm 6*c* is rocked to the intake valve 11 side, the pressing portion 6*h* of the roller arm 6*c* presses on the pressing surface 6*j* of the rocker arm main body 6*d*, causing the rocker arm main body 6*d* to rock to the intake valve 11 side, thereby making it possible to open and close the intake valve 11.

Further, the roller arm 6*c* is urged to the swing member 5 side by the leaf spring 28, so the outer peripheral surface of the roller 14 provided to the roller arm 6*c* is held in constant contact with the cam surface 5*a* of the swing member 5.

Further, an actuator (not shown) for rotating the rocker arm shaft 12 within a predetermined angle range about the center axis O5 is connected to one end portion of the rocker arm shaft 12. Connected to the actuator is control device (not shown) for controlling the angle of the actuator according to the operational state of the internal combustion engine.

Thus, when the rocker arm shaft 12 is rotated by a predetermined angle by the actuator, the eccentric shaft 29 provided to the rocker arm shaft 12 is turned by a predetermined angle about the center axis O5 of the rocker arm shaft 12. Further, when the eccentric shaft 29 is turned by the predetermined angle, the roller arm 6*c* operating in synchronization therewith is moved, for example, from the position indicated by the solid line in FIG. 8 to a predetermined position indicated by the chain double-dashed line in FIG. 8. Then, once the roller arm 6*c* has been moved to the predetermined position, the contact point where the cam surface 5*a* of the swing member 5 and the roller 14 provided to the roller arm 6*c* come into contact with each other changes. The rocking amount of the rocker arm main body 6*d* can be thus changed, which makes it possible to adjust the lift amount or the like of the intake valve 11 that is vertically moved by the rocker arm 6.

Further, even in the case where a predetermined gap is not provided between the valve pressing portion 6*a* of the rocker arm main body 6*d* and the intake valve 11, the predetermined gap (A) provided between the pressing portion 6*h* and the pressing surface 6*j* allows the intake valve 11 to be reliably opened/closed even when, due to a rise in the temperature of the internal combustion engine, the intake valve 11 undergoes thermal expansion to cause upward jumping or movement of the valve.

Also with the valve mechanism 1 for an internal combustion engine constructed as described above, in which the lift amount or the like of each valve can be adjusted by making the roller arm 6*c* be movable to the predetermined position and changing the contact position between the roller 14 provided to the roller arm 6*c* and the cam surface 5*a* of the swing member 5, the roller arm 6*c* is urged toward the swing member 5 side by the leaf spring 28. Accordingly, when the roller arm 6*c* has been moved to the predetermined position and the contact position between the roller 14 and the cam surface 5*a* changes, the roller 14 of the rocker arm 6 and the cam surface 5*a* of the swing member 5 meet each other, thereby making it possible to prevent adhesive wear.

Further, any leaf spring 28 may be used preferably as long as it has a stroke corresponding to the gap (A) provided between the roller arm 6*c* and the rocker arm 6, thereby allowing compact construction. In addition, the use of the leaf spring 28 advantageously provides a simple structure.

Further, although the roller arm 6*c* and the rocker arm 6 are formed as separate components and the number of components thus increases, they are pivotally supported by the common rocker arm shaft 12, whereby the construction of the support structure can be simplified.

Figure 9:
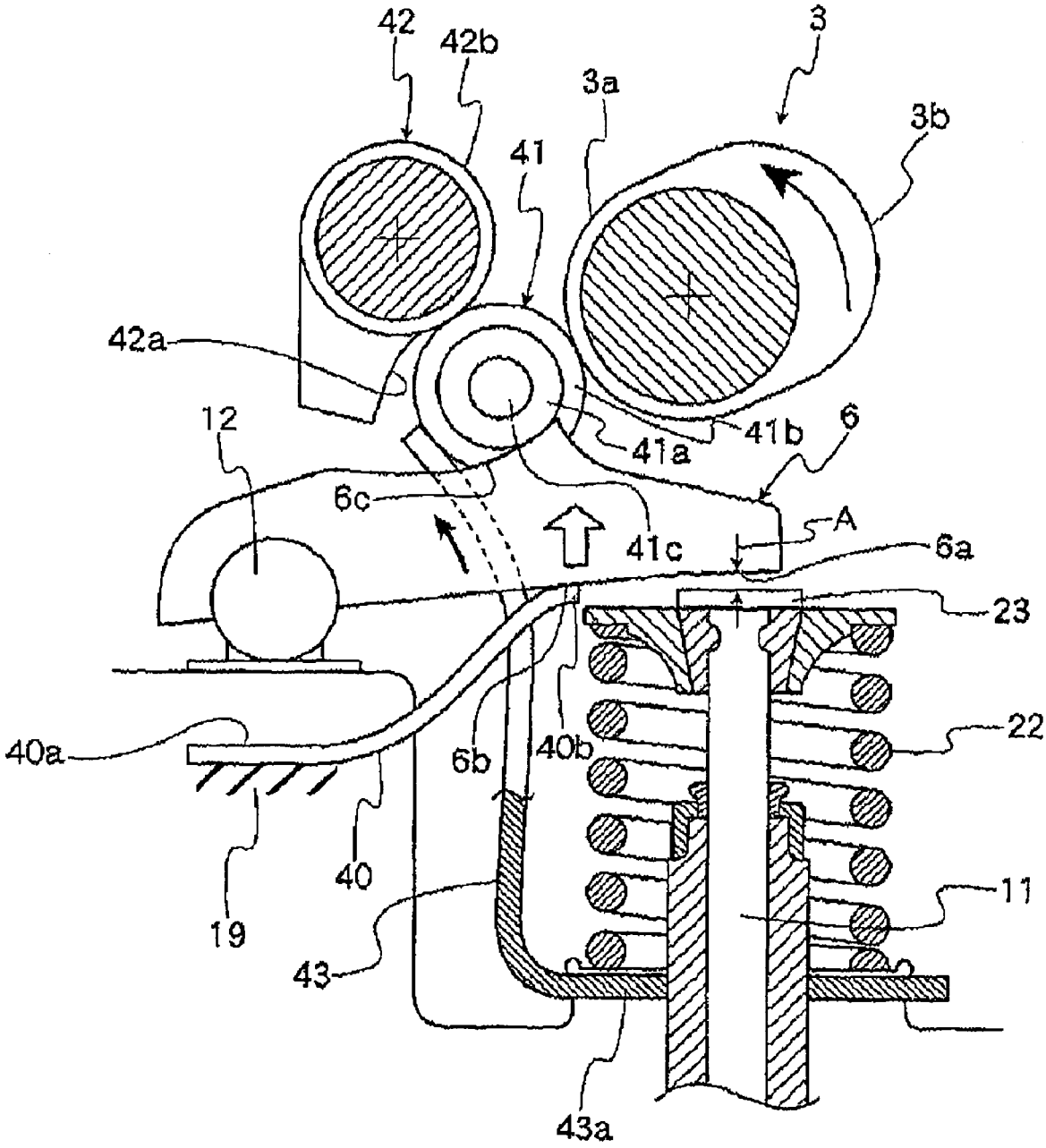
FIG. 9 is a cross-sectional side view of a seventh embodiment of a valve mechanism when the intake valve is closed.

FIG. 9 is a cross-sectional side view of a seventh embodiment of a valve mechanism for an internal combustion engine. Again, the valve is shown in a closed position.

According to this embodiment, the rocker arm 6 can be arranged to be vertically movable with respect to the cylinder head main body 19 via the rocker arm shaft 12. The shim 23 provided to the upper end portion of the intake valve 11 can be pressed by the pressing portion 6*a* of the rocker arm 6, whereby the intake valve 11 is pushed downwards to open against the urging force of the valve spring 22.

Further, a distal end portion 40*b* of a presser spring 40 is a "spring member" whose proximal end portion 40*a* is fixed to the cylinder head main body 19 is abutted against the lower surface portion 6*b* of the rocker arm 6, urging the rocker arm 6 to turn counterclockwise.

In this embodiment, a first roller 41*a* as a small "roller" of a roller member 41 is abutted against the upper surface 6*c* of the rocker arm 6. The first roller 41*a* and the upper surface 6*c* can be adapted to make reciprocating motion relative to each other. Further, a large second roller 41*b* of the roller member 41 can be held in abutment between the rotating cam 3 and a control member 42. The control member 42 can be constructed with a cam surface 42*a* having a ramp portion and a lift portion, and a base circle 42*b*. The upper surface can be is formed concentrically with the base circle 42*b*. The first and second rollers 41*a*, 41*b* are adapted to rotate about an axis 41*c*.

Thus, the roller member 41 can be arranged between the three components of the rocker arm 6, the rotating cam 3, and the control member 42. The rocker arm 6 is urged upwards by the presser spring 40, so the roller member 41 is always held in between the three components. Further, under the state where, as shown in FIG. 9, the intake valve 11 is closed, the second roller 41*b* of the roller member 41 is in contact with the base surface 3*a* of the rotating cam 3 and with the base circle 42*b* of the control member 42, and the first roller 41*a* of the roller member 41 is in contact with the upper surface 6*c* of the rocker arm 6, a gap (A) is produced between the pressing portion 6*a* of the rocker arm 6 and the intake valve 11.

Further, the roller member 41 is urged by a return spring 43 to bring the roller member 41 into press contact with the rotating cam 3 and the control member 42.

A proximal end portion 43*a* of the return spring 43 can be attached onto the intake valve side 11, and a distal end portion 43*b* thereof is abutted against the roller member 41. Thus, the roller member 41 is urged by the return spring 43 into press contact with the rotating cam 3 and the control member 42.

As the rotating cam 3 is turned in the direction indicated by the arrow in the drawing, the pressing position of the rotating cam 3 with respect to the roller member 41 shifts from the base surface 3*a* to the nose surface 3*b*. The roller member 41 is thus pressed by the nose surface 3*b*, causing the roller member 41 to move downwardly in the drawing along the portion from the base surface 42*b* of the control member 42 to the cam surface 42*a* thereof against the urging force of the return spring 43.

Due to this movement of the roller member 41, the upper surface 6*c* of the roller arm 6 is pressed, causing the rocker arm 6 to turn about the locker arm turn 12. Then, the pressing portion 6*a* of the rocker arm 6 is lowered to close the gap (A) and abuts against the shim 23 of the intake valve 11. By being pressed by the pressing portion 6*a*, the intake valve 11 is pushed down to open against the urging force of the valve spring 22.

On the other hand, as the pressing position of the rotating cam 3 with respect to the roller member 41 shifts from the nose surface 3*b* to the base surface 3*a*, the rocker arm 6 is turned upwards by the urging force of the valve spring 22 to thereby close the intake valve 11.

Further, since the rocker arm 6 is urged upwards by the presser spring 40, the roller member 41 is pressed upwards by the rocker arm 6, and the roller member 41 is pressed upwards by the return spring 43. Thus, the roller member 41 is always held in between the three components of the rotating cam 3, the rocker arm 6, and the control member 42.

In this state, the gap (A) is formed between the pressing portion 6*a* of the rocker arm 6 and the shim 23 of the intake valve 11.

As described above, when, with the intake valve 11 being closed, the second roller 41*b* of the roller member 41 is located at the base circle 42*b* of the control member 42, the gap (A) for absorbing errors and thermal expansion of respective portions of the valve system is provided between the pressing portion 6*a* of the rocker arm 6 and the shim 23 of the intake valve 11. Therefore, since it is not necessary to use a hydraulic lash adjustor as is conventionally used, adhesive wear between the first roller 41*a* of the roller member 41 and the upper surface 6*c* of the rocker arm 6 can be prevented by a simple structure and even when the internal combustion engine is rotating at high speed, thereby making it possible to achieve high level of reliability through secure operation.

Further, the presser spring 40 for bring the first roller 41*a* of the roller member 41 and the upper surface 6*c* of the rocker arm 6 into contact with each other during the relative reciprocating motion between the rocker arm 6 and the roller member 41 is provided, whereby adhesive wear can be prevented only by adding a simple structure.

Figure 10:
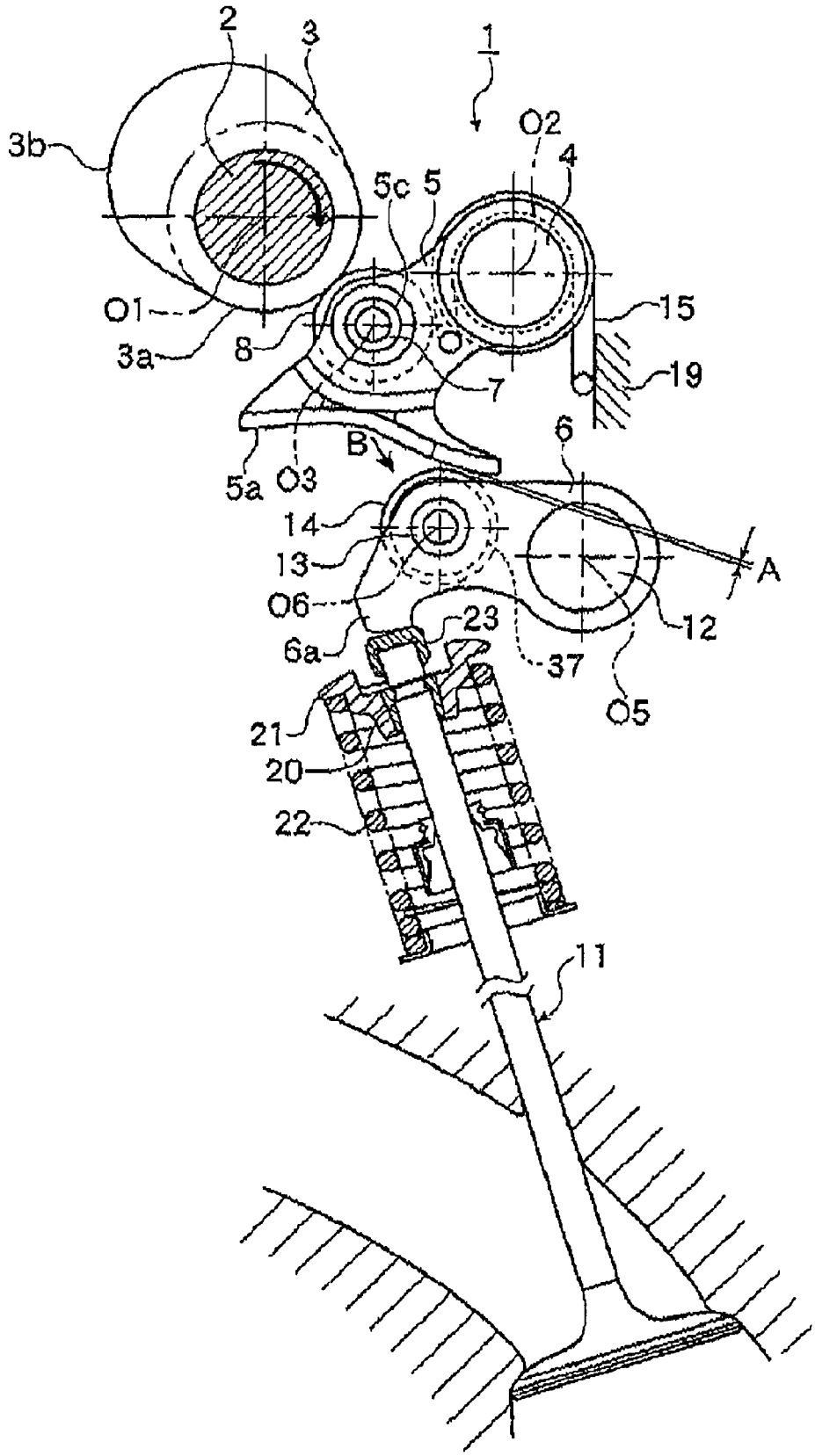
FIG. 10 is a cross-sectional side view of an eighth embodiment of a valve mechanism when the intake valve is closed.
Figure 11:
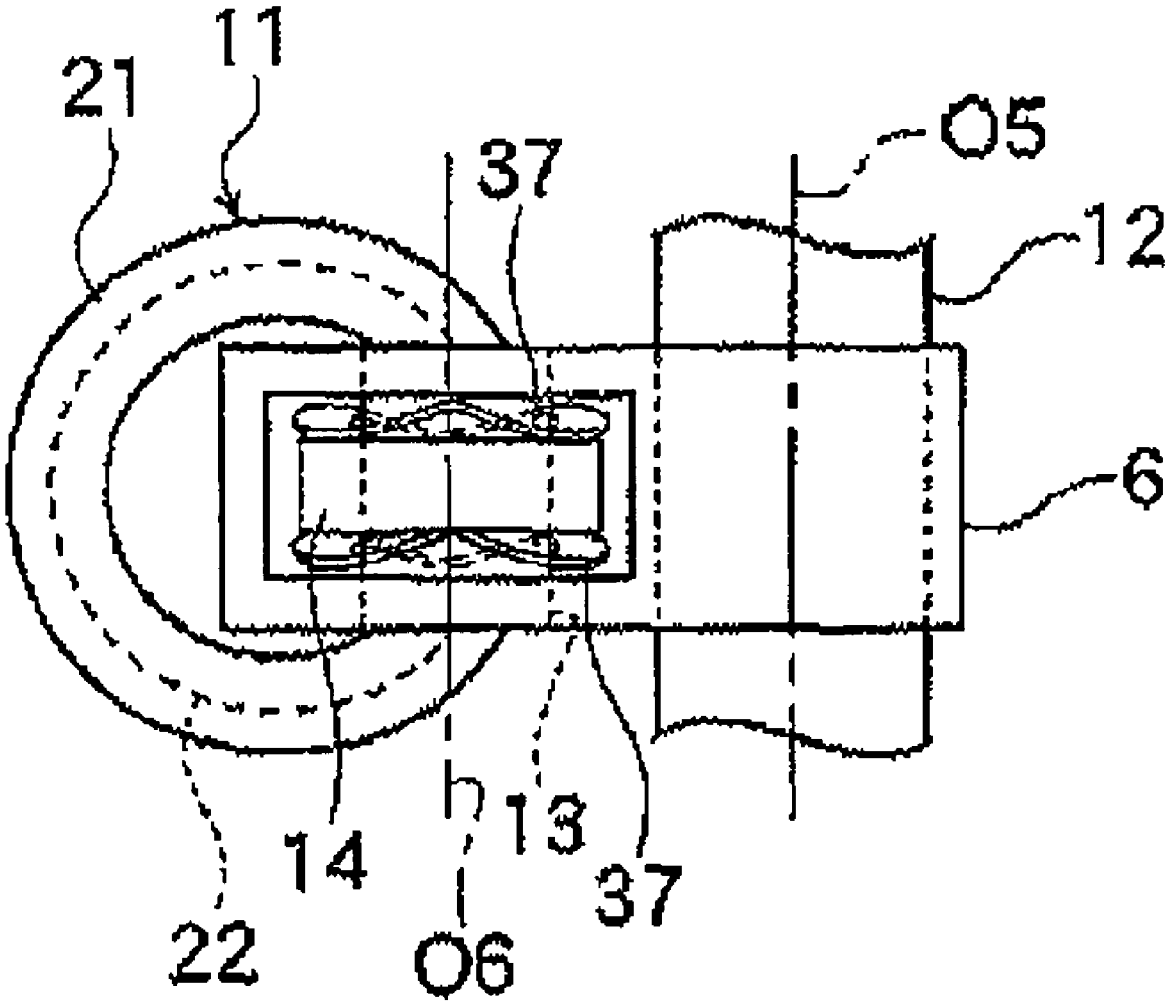
FIG. 11 is an enlarged view, as seen in the direction of the arrow B of FIG. 10, of a rocker arm.

FIGS. 10 and 11 show an eighth embodiment of a valve drive mechanism. FIG. 10 is a cross-sectional side view of the main portion of valve mechanism for an internal combustion engine, illustrating a state in which the intake valve is closed, and FIG. 11 is an enlarged view of the main portion of the rocker arm as seen in the direction indicated by the arrow B of FIG. 10.

In this embodiment, the rocker arm 6 has, instead of the spring member of the first embodiments, a braking device for restraining the roller 14 provided to the rocker arm 6 from rotating due to inertia under the state in which, during the reciprocating motion of the swing member 5 and the rocker arm 6, the cam surface 5*a* of the swing member 5 and the roller 14 are not in contact with each other.

Further, as shown in FIGS. 10 and 11, the braking device of this embodiment comprises a waved washer 37 as a restraining member. The washer 37 is arranged between the roller 14 and the rocker arm 6 to which the roller arm 14 is provided. Specifically, the waved washer 37 is arranged between the rocker arm 6 and the roller 14 while being arranged on the side surface side of the roller 14 to be in fitting engagement with the outer peripheral surface of the roller shaft 13.

When the swing member 5 finishes its lift, and the cam surface 5*a* and the roller 14 are separated from each other, the roller 14 tries to keep rotating due to inertia; at this time, since the waved washer 37 is provided to the roller shaft 3, the rotation of the roller 14 is restrained due to the frictional resistance. Then, when the swing member 5 tries to start its lift again, and the cam surface 5*a* and the roller 14 come into contact with each other, since the relative speed between the swing member 5 and the roller 14 has been reduced, adhesive wear between the roller 14 and the cam surface 5*a* can be prevented or reduced.

It should be noted that while in this embodiment the rotation of the roller 14 due to inertia is restrained by bringing the waved washer 37 as the restraining member into fitting engagement with the roller shaft 13, there is no particular limitation as to the restraining member used as long as it is capable of restraining the rotation of the roller 14 due to inertia.

In the valve mechanism 1 for an internal combustion engine constructed as described above, the cam surface 5*a* with which the roller 14 comes in contact is provided to the swing member 5 that makes reciprocating motion while rocking the swing member shaft 4 within the predetermined range, and the roller 14 for causing the rocker arm 6 to operate in synchronization with the rocking motion of the swing member 5 is provided to the rocker arm 6 that makes reciprocating motion while rocking within the predetermined range in synchronization with the swing member 5. The valve mechanism 1 also has the braking device for restraining the rotation of the roller 14 due to inertia in the state where the cam surface 5*a* of the swing member 5 and the roller 14 are not in contact with each other during the reciprocating motion of the swing member 5 and the rocker arm 6, whereby it is not necessary to use a hydraulic lash adjustor as is conventionally used. Accordingly, adhesive wear between the roller 14 and the cam surface 5*a* can be prevented or reduced by a simple structure and even when the internal combustion engine is rotating at high speed.

Further, the braking device in the form of the waved washer 37 can be arranged between the roller 14 and the swing member 5 or rocker arm 6 to which the roller 14 is provided, and serves as the restraining member for restraining the rotation of the roller 14 due to inertia. Accordingly, the construction of the valve mechanism can be simplified to allow a reduction in cost. Further, since the waved washer 37 is simply brought into fitting engagement with the roller shaft 13, whereby the assembly process can be simplified and it is possible to achieve compact construction of the valve mechanism 1.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A valve drive mechanism for actuating a valve of an internal combustion engine, the valve drive mechanism comprising:

a camshaft rotated by a crankshaft of the internal combustion engine;

a cam provided on the camshaft;

a swing member support shaft that is coaxial or in parallel to the camshaft;

a swing member pivotally supported on the swing member support shaft, the swing member configured to be actuated by the cam for reciprocal motion;

a roller follower that is configured to be actuated by the swing member for reciprocal motion to open and close the valve; and a spring member;

wherein the swing member rocks within a predetermined range about the swing member support shaft, and the roller follower reciprocates within a predetermine range in synchronization with the swing member;

wherein one of the swing member and the roller follower is provided with a roller for causing the roller follower to move in synchronization with the rocking motion of the swing member, and the other is provided with a contact surface that contacts the roller, the contact surface including a base circle portion and a lift portion;

wherein when the roller contacts the base circle portion, a gap for absorbing errors or thermal expansion of respective portions of the valve drive mechanism system exists between components on a downstream side in a force transmission path with respect to a contact portion between the roller and the cam surface; and wherein the spring member brings the roller and the contact surface into constant contact with each other during the reciprocating motion of the swing member and the roller follower.

2. The valve drive mechanism according to claim 1, wherein the spring member comprises a torsion spring that engages a rocker arm shaft that pivotally supports a rocker arm that supports the roller.

3. The valve drive mechanism according to claim 2, wherein the torsion spring is coupled onto the rocker arm at one end and is coupled onto a cylinder head main body at the other end and is configured to urge the rocker arm toward the swing member.

4. The valve drive mechanism according to claim 1, wherein the spring member is provided between a rocker arm, which supports the roller, and a cylinder head main body.

5. The valve drive mechanism according to claim 4, wherein the spring member comprises a coil spring configured urge the rocker arm towards the swing member.

6. A valve drive mechanism for an internal combustion engine, the valve drive mechanism comprising:

a camshaft rotated by a crankshaft of the internal combustion engine;

a cam provided on the camshaft;

a swing member support shaft positioned coaxially or in parallel to the camshaft;

a swing member pivotally supported on the swing member support shaft and configured to be pivoted by the cam; and a roller follower that is configured to be reciprocally moved by the swing member to open and close an intake valve or an exhaust valve of the internal combustion engine;

wherein the swing member pivots within a predetermined range about the swing member support shaft, and the roller follower reciprocates within a predetermine range in synchronization with the swing member;

wherein one of the swing member and the roller follower is provided with a roller for causing the roller follower to operate in synchronization with pivoting motion of the swing member, and the other is provided with a contact surface that contacts the roller, and wherein a brake is provided and configured to restrain rotation of the roller due to inertia when the contact surface and the roller are not in contact with each other during reciprocating motion of the swing member and the roller follower.

7. The valve mechanism for an internal combustion engine according to claim 6, wherein the brake is arranged between the roller and the swing member.

* * * * *